US009338573B2

(12) United States Patent
Thompson

(10) Patent No.: US 9,338,573 B2
(45) Date of Patent: May 10, 2016

(54) MATRIX DECODER WITH CONSTANT-POWER PAIRWISE PANNING

(71) Applicant: Jeffrey Kenneth Thompson, Bothell, WA (US)

(72) Inventor: Jeffrey Kenneth Thompson, Bothell, WA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 14/447,516

(22) Filed: Jul. 30, 2014

(65) Prior Publication Data

US 2015/0036849 A1 Feb. 5, 2015

Related U.S. Application Data

(60) Provisional application No. 61/860,024, filed on Jul. 30, 2013.

(51) Int. Cl.
*H04R 5/00* (2006.01)
*H04S 3/02* (2006.01)

(52) U.S. Cl.
CPC ..... *H04S 3/02* (2013.01); *H04R 2227/003* (2013.01); *H04S 2400/03* (2013.01); *H04S 2400/07* (2013.01); *H04S 2400/13* (2013.01)

(58) Field of Classification Search
CPC ..... H04S 3/02
See application file for complete search history.

(56) References Cited

U.S. PATENT DOCUMENTS 5,291,557 A 3/1994 Davis et al.
5,319,713 A 6/1994 Waller, Jr. et al.
5,638,452 A 6/1997 Waller, Jr.
5,771,295 A 6/1998 Waller, Jr.
5,870,480 A 2/1999 Griesinger
6,507,658 B1 1/2003 Abel et al.
6,665,407 B1 12/2003 Dicker et al.

(Continued)

FOREIGN PATENT DOCUMENTS

WO 2010097748 A1 9/2010
WO 2013006338 A2 1/2013
WO 2014160576 A2 10/2014

OTHER PUBLICATIONS

International Search Report and Written Opinion issued in PCT Application No. PCT/US2014/067763, ten pages, mailed Feb. 25, 2015.

(Continued)

*Primary Examiner* — Joseph Saunders, Jr.
(74) *Attorney, Agent, or Firm* — Blake Welcher; William Johnson; Craig Fischer

(57) ABSTRACT

A constant-power pairwise panning upmixing system and method for upmixing from a two-channel stereo signal to a multi-channel surround sound (having more than two channels). Each output channel is some combination of the two input channels. Closed-form solutions are used to calculate dematrixing coefficients that are used to weight each input channel. The dematrixing coefficients are computed based on an inter-channel level difference and an inter-channel phase difference between the two input signals. The weighted input channels then are mixed uniquely for each output channel to generate a surround sound output from the stereo input signal. Each dematrixing coefficient has an in-phase component and an out-of-phase component. The phase coefficients for each component vary in time and are based on the phase difference between the input signals. The resultant surround sound output faithfully simulates the audio content as originally mixed.

23 Claims, 10 Drawing Sheets

(56) References Cited

U.S. PATENT DOCUMENTS

| | | | |
|---|---|---|---|
| 7,003,467 | B1 | 2/2006 | Smith et al. |
| 7,283,634 | B2 | 10/2007 | Smith |
| 7,283,684 | B1 | 10/2007 | Keenan |
| 7,391,870 | B2 | 6/2008 | Herre et al. |
| 7,933,415 | B2 | 4/2011 | Breebaart |
| 8,385,556 | B1 | 2/2013 | Warner et al. |
| 2003/0235317 | A1 | 12/2003 | Baumgarte |
| 2005/0052457 | A1 | 3/2005 | Muncy et al. |
| 2006/0009225 | A1 | 1/2006 | Herre et al. |
| 2006/0115100 | A1 | 6/2006 | Faller |
| 2008/0205676 | A1 | 8/2008 | Merimaa et al. |
| 2011/0103592 | A1 | 5/2011 | Kim et al. |
| 2011/0249822 | A1 | 10/2011 | Jaillet et al. |
| 2013/0216047 | A1 | 8/2013 | Kuech et al. |

OTHER PUBLICATIONS

Pulkki, Spatial Sound Generation and Perception by Amplitude Panning Techniques. Scientific article, 2001 [retrieved on Feb. 3, 2015]. Retrieved from the Internet: <URL: https://aaltodoc.aalto.fi/bitstream/handle/123456789/2345/isbn9512255324.pdf?sequence=1> entire document.

Chan Jun Chun, Yong Guk Kim, Jong Yeol Yang, and Hong Kook Kim, "Real-Time Conversion of Stereo Audio to 5.1 Channel Audio for Providing Realistic Sounds," International Journal of Signal Processing, Image Processing and Pattern Recognition vol. 2, No. 4, Dec. 2009, Gwangju, Korea.

Mingsian R. Bai and Geng-Yu Shih, "Upmixing and Downmixing Two-channel Stereo Audio for Consumer Electronics," IEEE Transaction on Consumer Electronics, Aug. 2007, pp. 1011-1019, vol. 53, Issue: 3, IEEE, New Jersey, USA.

Julia Jakka, "Binaural to Multichannel Audio Upmix," Helsinki University of Technology, Jun. 6, 2005, Aalto, Finland.

Merce Serra and Olaf Korte, "Experiencing Multichannel Sound in Automobiles: Sources, Formats and Reproduction Modes," Fraunhofer Institute for Integrated Circuits IIS, Version 2012, Jul. 2012, Erlangen, Germany.

David Griesinger, "Multichannel matrix surround decoders for two-eared listeners," Journal of the Audio Engineering Society, Nov. 1, 1996, Los Angeles, California, USA, Preprint #4402, 21 pages.

Roger Dressler, "Dolby Surround Pro Logic II Decoder Principles of Operation," (2000) Dolby Laboratories, Inc., San Francisco, California, USA, pp. 1-7.

Roger Dressler, "Dolby Surround Pro Logic Decoder Principles of Operation," 1993, Dolby Laboratories, Inc., San Francisco, California, USA.

Kenneth Gundry, "A New Active Matrix Decoder for Surround Sound," AES 19th International Conference, Jun. 1, 2001, New York, New York, USA, pp. 552-559.

John M. Eargle, "Multichannel Stereo Matrix Systems: An Overview," Journal of the Audio Engineering Society, Jul. 1, 1971, New York, New York.

David Griesinger, "Progress in 5-2-5 Matrix Systems," Audio Engineering Society, 103rd Convention, Sep. 26-29, 1997, New York, New York.

International Search Report and the Written Opinion of the International Searching Authority, in corresponding PCT Application No. PCT/US2014/048975, mailed Jul. 30, 2014.

International Preliminary Report on Patentability in the corresponding PCT Application No. PCT/US2014/48975, mailed Sep. 11, 2015, 17 pages.

MATRIX DECODER WITH CONSTANT-POWER PAIRWISE PANNING

CROSS-REFERENCE TO RELATED APPLICATIONS

This application claims the benefit of U.S. Provisional Patent Application Ser. No. 61/860,024 filed Jul. 30, 2013, titled "MATRIX DECODER WITH CONSTANT-POWER PAIRWISE PANNING", the entire contents of which is hereby incorporated herein by reference.

BACKGROUND

Many audio reproduction systems are capable of recording, transmitting, and playing back synchronous multi-channel audio, sometimes referred to as "surround sound." Though entertainment audio began with simplistic monophonic systems, it soon developed two-channel (stereo) and higher channel-count formats (surround sound) in an effort to capture a convincing spatial image and sense of listener immersion. In particular, surround sound is a technique for enhancing reproduction of an audio signal by using more than two audio channels. Content is delivered over multiple discrete audio channels and reproduced using an array of loudspeakers (or speakers). The additional audio channels, or "surround channels," provide an immersive listening experience for a listener.

Surround sound systems typically have speakers positioned around the listener to give the listener a sense of sound localization and envelopment. Many surround sound systems having only a few channels (such as a 5.1 format) have the speakers positioned in specific locations in a 360-degree arc about the listener. These speakers are arranged such that all of the speakers are in the same plane. Moreover, the listener's ears are also approximately in the same plane as each of the speakers. Higher-channel count surround sound systems (such 7.1, 11.1, and so forth) also include height or elevation speakers that are positioned above the plane of the listener's ears. Often these surround sound configurations include a discrete low-frequency effects (LFE) channel that provides additional low-frequency bass audio to supplement the bass audio in the other audio channels. Because this LFE channel requires only a portion of the bandwidth of the other audio channels, it is designated as the ".X" channel, where X is any positive integer including zero (as in 5.1 or 7.1 surround sound).

Ideally surround sound audio is mixed into discrete channels and those channels are kept discrete through playback to the listener. In reality, however, storage and transmission limitations dictate that the file size of the surround sound audio be reduced to minimize storage space and transmission bandwidth. Moreover, two-channel audio content is typically compatible with a larger variety of broadcasting and reproduction systems as compared to audio content having more than two channels.

Matrixing was developed to address these needs. Matrixing involves "downmixing" an original signal having more than two discrete audio channels into a two-channel audio signal. The additional channels are downmixed according to a pre-determined process to generate a two-channel downmix that includes information from all of the audio channels. The additional audio channels may later be extracted and synthesized from the two-channel downmix using an upmix process such that the original channel mix can be recovered to some level of approximation. Upmixing accepts the two-channel audio signal as input and generates a larger number of channels for playback. The playback is an acceptable approximation of the discrete audio channels of the original signal.

Some upmixing techniques use constant-power panning. The concept of "panning" is derived from the film world and specifically the word "panorama." Panorama means to have a complete visual view of a given area in every direction. In the audio realm, audio can be panned in the stereo field so that the audio is perceived as being positioned in physical space such that all the sounds in a performance are heard by a listener in their proper location and dimension. For musical recordings, a common practice is to place the musical instruments where they would be physically located on a real stage. For example, stage left instruments are panned left and stage right instruments are panned right. This idea seeks to replicate a real-life performance for the listener during playback.

Constant-power panning maintains constant signal power across audio channels as the input audio signal is distributed among them. Although constant-power panning is widespread, current downmixing and upmixing techniques struggle to preserve and recover the precise panning behavior and localization present in an original mix. In addition, some techniques are prone to artifacts, and all have limited ability to separate independent signals that overlap in time and frequency but originate from different spatial directions.

For example, some popular upmixing techniques use voltage-controlled amplifiers to normalize both input channels to approximately the same level. These two signals then are combined in an ad-hoc manner to produce the output channels. Due to this ad-hoc approach, however, the final output has difficulty achieving desired panning behaviors and includes problems with crosstalk and at best approximates discrete surround-sound audio.

Other types of upmixing techniques are precise only in a few panning locations but are imprecise away from those locations. By way of example, some upmixing techniques define a limited number of panning locations where upmixing results in precise and predictable behavior. Dominance vector analysis is used to interpolate between a limited number of pre-defined sets of dematrixing coefficients at the precise panning location points. Any panning location falling between the points use interpolation to find the dematrixing coefficient values. Due to this interpolation, panning locations falling between the precise points can be imprecise and adversely affect audio quality.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Embodiments of the constant-power pairwise panning upmixing system and method preserve and recover the precise panning localization during the upmix process. This is achieved using a closed-form solution to generate precise and correct dematrixing coefficients. These dematrixing coefficients are used to determine how much of the original two channels are mixed into the new output channels. This closed-form solution precisely and exactly solves for the dematrixing coefficients at any panning locations. Any panning location can be precisely determined from the downmixed two-channel audio for any point 360 degrees around the listener in the horizontal plane that includes the speakers and the listener's ears.

The precision of the closed-form solution leads to improved sound of the upmixed audio that is reproduced to a listener. By way of example and not limitation, assume that the audio content was originally mixed in two channels and contains a sequence where the audio is slowly panned from the left channel to the right channel using a Sin/Cos panning law. If the two channels are upmixed to a 5.1 target speaker layout using embodiments of the constant-power pairwise panning upmixing system and method, then that sequence will start at the left channel, then will slowly begin to pan to the center channel, as it gets to the center channel it will be discretely in the center, then it will begin to pan between the center and the right channel. The surround speakers will remain silent the entire time.

On the other hand, because current upmixing techniques lack a closed-form solution framework, in the same situation the audio will start at the left channel and as it reaches the point between the left and center channels there will be leakage into the right channel and the surround channels. The audio will be discrete in the center channel because this is one of the pre-determined interpolation points. As the audio moves to the point between the center and right channels there will be leakage into the left channel and the surround channels. This is because when the audio is between the left and center channels and the right and center channels, current methods perform an interpolation of dematrixing coefficients. Because the dematrixing coefficients are not precisely correct there is leakage between channels.

Embodiments of the constant-power pairwise panning upmixing system and method are used to upmix a stereo audio signal having two channels to a target speaker layout having more than two channels. The target speaker layout can have virtually any number of channels. However, embodiments of the constant-power pairwise panning upmixing system and method are restricted to target speaker layouts having speakers that are located approximately in the same plane as the listener's ears. This concept is discussed in more detail below.

The constant-power pairwise panning upmixing system and method makes an assumption about the type of panning laws that were used during the creation of the audio content. In other words, the system and method assume that a certain panning law was used by either the downmixing process or by the mixing engineer. In some embodiments, the constant-power pairwise panning upmixing system and method assume a Sin/Cos pan law. In other embodiments, several different other types of panning laws may be used.

The panning laws are assumed by embodiments of the constant-power pairwise panning upmixing system and method because it typically will not know the panning laws that were used in the creation or downmixing of the content. In addition, the system and method usually will receive as input one of two types of stereo input signals. Generally, therefore, the system, and method operates in one of two modes, and usually is not aware of which mode it is operating.

The first mode is processing an already downmixed audio signal. For example, content that was originally recorded in 5.1 is downmixed to a matrix-encoded stereo signal and provided to the system and method. In this situation the matrix-encoded stereo signal is passed along to the upmixer for upmixing and rendering on a playback device. The second mode is used when the input is a stereo audio signal having stereo-mixed content that was original mixed in stereo and never downmixed. This includes, for example, content that was originally mixed into a legacy stereo signal and never downmixed. In this situation, the stereo signal is upmixed to a higher-channel count mix, such as a 7.1 mix.

Regardless of the history of the input stereo signal, the signal is analyzed to recover an estimate of the underlying parameters that were used in the panning laws during content creation. These parameters include the panning angles that were used in the creation of the content. These estimated parameters are used during the upmix process to obtain dematrixing coefficients. The dematrixing coefficients are used to generate output channels with as accurate channel energies as when the original signal was created.

The upmixed signal then is reproduced across the target speaker layout. Typically, the target speaker layout contains a channel count equal to or higher than the original audio signals. For example, the original stereo signal could be upmixed to a target speaker layout of 5.1, 7.1, or 9.1. As noted above, however, embodiments of the constant-power pairwise panning upmixing system and method are limited to speaker configurations that are roughly in the same plane as the listener's ears. In other words, each of the speakers in the target speaker layout is in the same plane, and that horizontal plane roughly includes both ears of the listener. This means that the target speaker layout does not include any out-of-horizontal plane speakers, such as height or elevated speakers.

Embodiments of the constant-power pairwise panning upmixing system and method include upmixing a two-channel input audio signal having a first input channel and a second input channel into an upmixed multi-channel output audio signal having greater than two channels. The method calculates a first dematrixing coefficient and a second dematrixing coefficient based on an inter-channel level difference (ICLD) and an inter-channel phase difference (ICPD) between the first and second input channels. The method then multiplies the first input channel by the first dematrixing coefficient to generate a first sub-signal and multiplies the second input channel by the second dematrixing coefficient to generate a second sub-signal. These two sub-signals are mixed together in a linear manner to generate an output channel of the upmixed multi-channel output audio signal. The generated output channel is output for playback through a target speaker layout. The target speaker layout may include a plurality of speakers or may be headphones.

Embodiments of the constant-power pairwise panning upmixing system and method also include a method for generating an upmixed multi-channel output audio signal having N output channels from a two-channel input audio signal having a left input channel and a right input channel. In addition, N is a positive integer greater than two. The method calculates the first dematrixing coefficient based on a first trigonometric function of a combination of an in-phase signal component and an out-of-phase signal component. In addition, the method calculates a second dematrixing coefficient based on a second trigonometric function of the combination of the in-phase signal component and the out-of-phase signal component.

The method then generates each of the N output channels by mixing in a linear manner the first dematrixing coefficient times the left or right input channel and the second dematrixing coefficient times the right or left input channel. The method also causes each of the N output channels of the upmixed multi-channel output audio signal to be played back through speakers in a multi-channel playback environment.

It should be noted that alternative embodiments are possible, and steps and elements discussed herein may be changed, added, or eliminated, depending on the particular embodiment. These alternative embodiments include alternative steps and alternative elements that may be used, and structural changes that may be made, without departing from the scope of the invention.

DRAWINGS DESCRIPTION

Referring now to the drawings in which like reference numbers represent corresponding parts throughout:

DETAILED DESCRIPTION

In the following description of embodiments of a constant-power pairwise panning upmixing system and method reference is made to the accompanying drawings. These drawings shown by way of illustration specific examples of how embodiments of the constant-power pairwise panning upmixing system and method may be practiced. It is understood that other embodiments may be utilized and structural changes may be made without departing from the scope of the claimed subject matter.

I. System Overview

Embodiments of the constant-power pairwise panning upmixing system and method upmix a two-channel input audio signal to a multi-channel output audio signal having more than two channels using a closed-form solution to precisely determine dematrixing coefficients. These dematrixing coefficients are used to weight each of the two input channels and determine how much of each input channel is contained in each output channel. Embodiments of the constant-power pairwise panning upmixing system and method are used to create a surround sound experience with multiple output channels for a listener when the input is a stereo signal.

Figure 1:
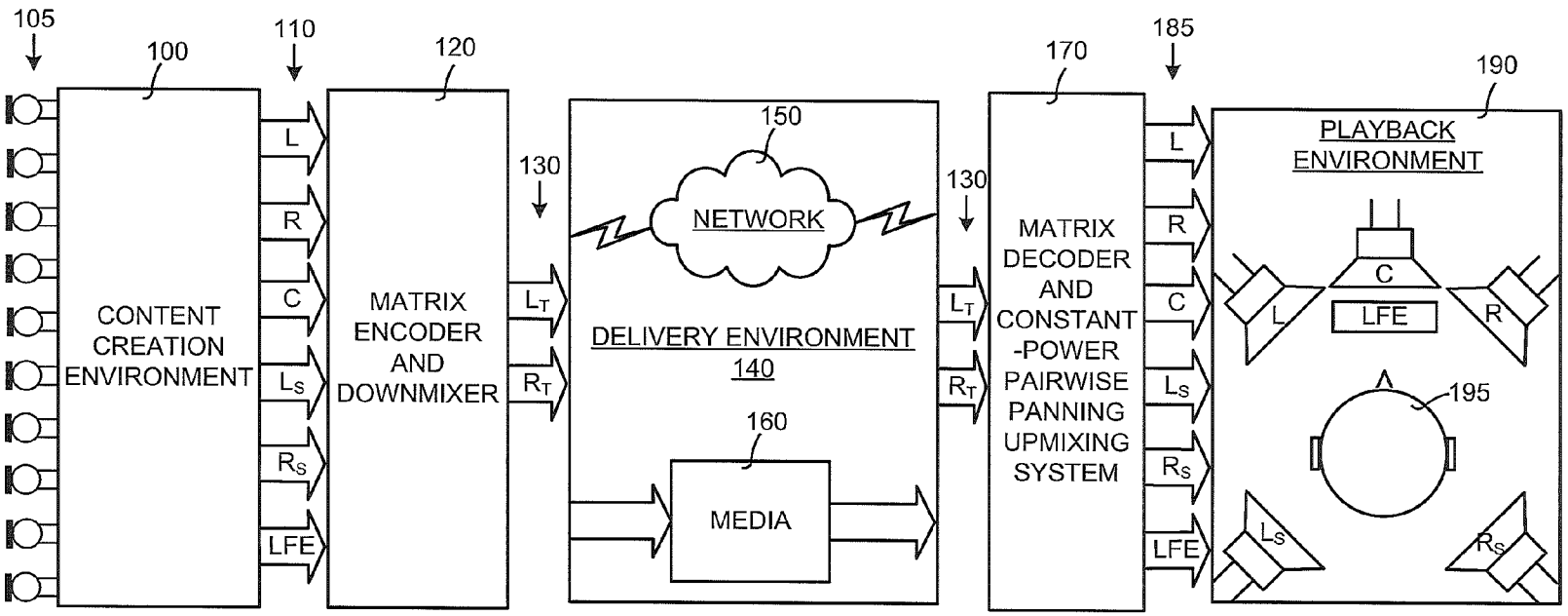
FIG. 1 is a block diagram illustrating a general overview of embodiments of the constant-power pairwise panning upmixing system and method.

FIG. 1 is a block diagram illustrating a general overview of embodiments of the constant-power pairwise panning upmixing system and method. Referring to FIG. 1, audio content (such as musical tracks) is created in a content creation environment 100. This environment 100 may include a plurality of microphones 105 (or other sound-capturing devices) to record audio sources. Alternatively, the audio sources may already be a digital signal such that it is not necessary to use a microphone to record the source. Whatever the method of creating the sound, each of the audio sources is mixed into a final mix as the output of the content creation environment 100.

In FIG. 1, the final mix is a final 5.1 mix 110 such that each of the audio sources is mixed into six channels including a Left channel (L), a Right channel (R), a Center channel (C), a Left Surround channel ($L_S$), a Right Surround channel ($R_S$), and a Low-Frequency Effects (LFE) channel. Although the final mix shown in FIG. 1 is a 5.1 mix, it should be noted that other final mixes are possible, including a mix having a greater number of channels and a mix having a lesser number of channels (such as a stereo or mono mix). The final 5.1 mix 110 then is encoded and downmixed (if necessary) using a matrix encoder and downmixer 120. The matrix encoder and downmixer 120 are typically located on a computing device having one or more processing devices. The matrix encoder and downmixer 120 encodes and downmixes the final 5.1 mix into a stereo mix 130 having a Left Total channel ($L_T$) and a Right Total channel ($R_T$).

The stereo mix 130 is delivered for consumption by a listener in a delivery environment 140. Several delivery options are available, including streaming delivery over a network 150. Alternatively, the stereo mix 130 may be recorded on a media 160 such as optical disk or film for consumption by the listener. In addition, there is many other delivery options not enumerated here that may be used to deliver the stereo mix 130.

Whatever the delivery method, the stereo mix 130 is input to a matrix decoder and upmixer 170. The matrix decoder and upmixer 170 includes embodiments of the constant-power pairwise panning upmixing system and method. The matrix encoder and downmixer 120 and embodiments of the constant-power pairwise panning upmixing system and method 180 are typically located on a computing device having one or more processing devices.

The matrix decoder and upmixer 170 decodes each channel of the stereo mix 130 and expands them into discrete output channels. In FIG. 1 is shown a reconstructed 5.1 mix 185 that is the stereo mix 130 expanded into a 5.1 output. This reconstructed 5.1 mix 185 is reproduced in a playback environment 190 that includes a target speaker layout including speakers that correspond to the reconstructed channels. These speakers include a Left speaker, a Right speaker, a Center speaker, a Left Surround speaker, a Right Surround speaker, and a LFE speaker. In other embodiments, the target speaker layout may be headphones such that the speakers are merely virtual speakers from which sound appears to originate in the playback environment 190. For example, the listener 195 may be listening to the reconstructed 5.1 mix through headphones. In this situation, the speakers are not actual physical speakers but sounds appear to originate from different spatial locations in the playback environment corresponding, for example, a 5.1 surround sound speaker configuration.

Whether the target speaker layout is actual speakers or headphones, the playback of the reconstructed 5.1 mix 185 provides the listener 195 with an immersive surround sound experience from a stereo input audio signal. It should be noted that although the target speaker layout is a 5.1 configuration, in other embodiments any number of speakers may be used as long as the number is greater than two.

Figure 2:
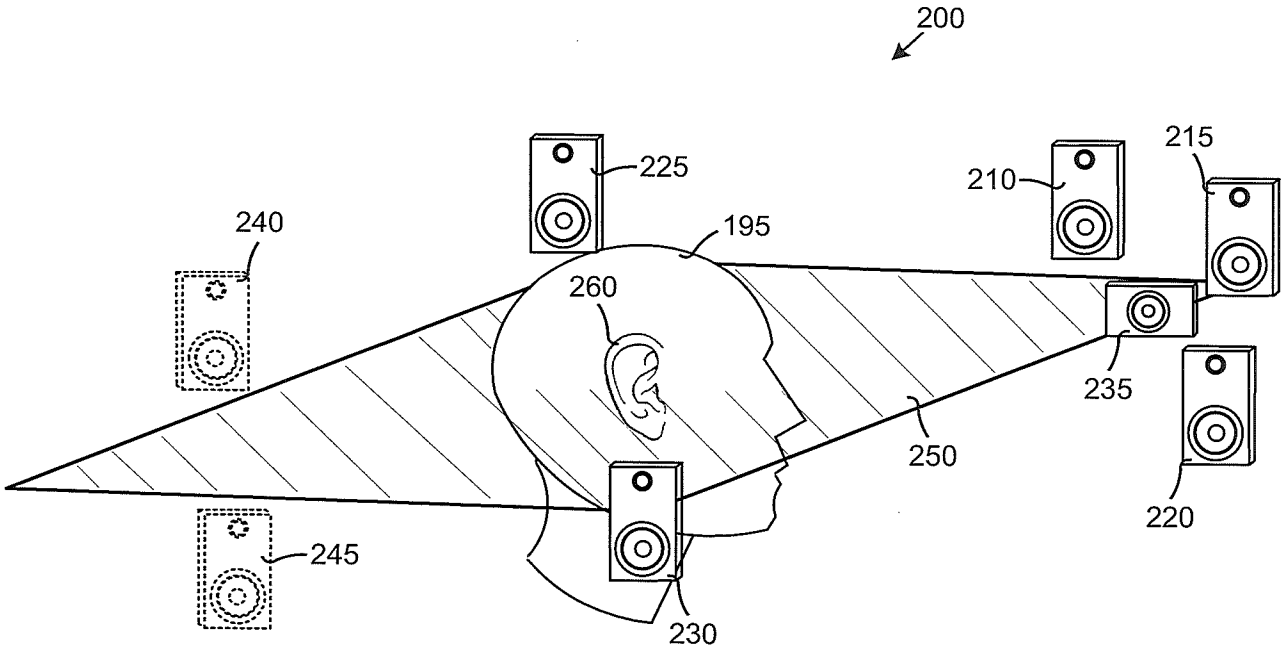
FIG. 2 is an illustration of the concept of a target speaker layout having speakers in the same plane as the listener's ears.

Embodiments of the constant-power pairwise panning upmixing system 180 and method are designed such that the playback environment 190 includes speakers that are located in the same horizontal plane and that plane includes the listener's ears. FIG. 2 is an illustration of the concept of a target speaker layout 200 having speakers in the same plane as the listener's ears. As shown in FIG. 2, the listener 195 is listening to content that is rendered on the target speaker layout 200. The target speaker layout 200 is a 5.1 layout having a left speaker 210, a center speaker 215, a right speaker 220, a left surround speaker 225, and a right surround speaker 230. The 5.1 layout shown also includes a low-frequency effects (LFE or "subwoofer") speaker 235. In some embodiments the target speaker layout 200 is a 7.1 layout. The two additional speakers are shown as dashed lines to indicate that they are optional. These two additional speakers include a surround back left speaker 240 and a surround back right speaker 245.

Each of the speakers is located in a horizontal plane 250. In addition, each of the listener's ears 260 also is located in the horizontal plane 250. Although a 5.1 and 7.1 layout are shown in FIG. 2, embodiments of the constant-power pairwise panning upmixing system 180 and method can be generalized such that content could be upmixed from any stereo layout into any layout in the horizontal plane 250 of the user's ear 260 encircling the user.

It should be noted that in FIG. 2 the speakers in the target speaker layout and the listener's head and ears are not to scale with each other. In particular, the listener's head and ears are shown larger than scale to illustrate the concept that each of the speakers and the listener's ears are in the same horizontal plane 250.

II. System Details

Figure 3:
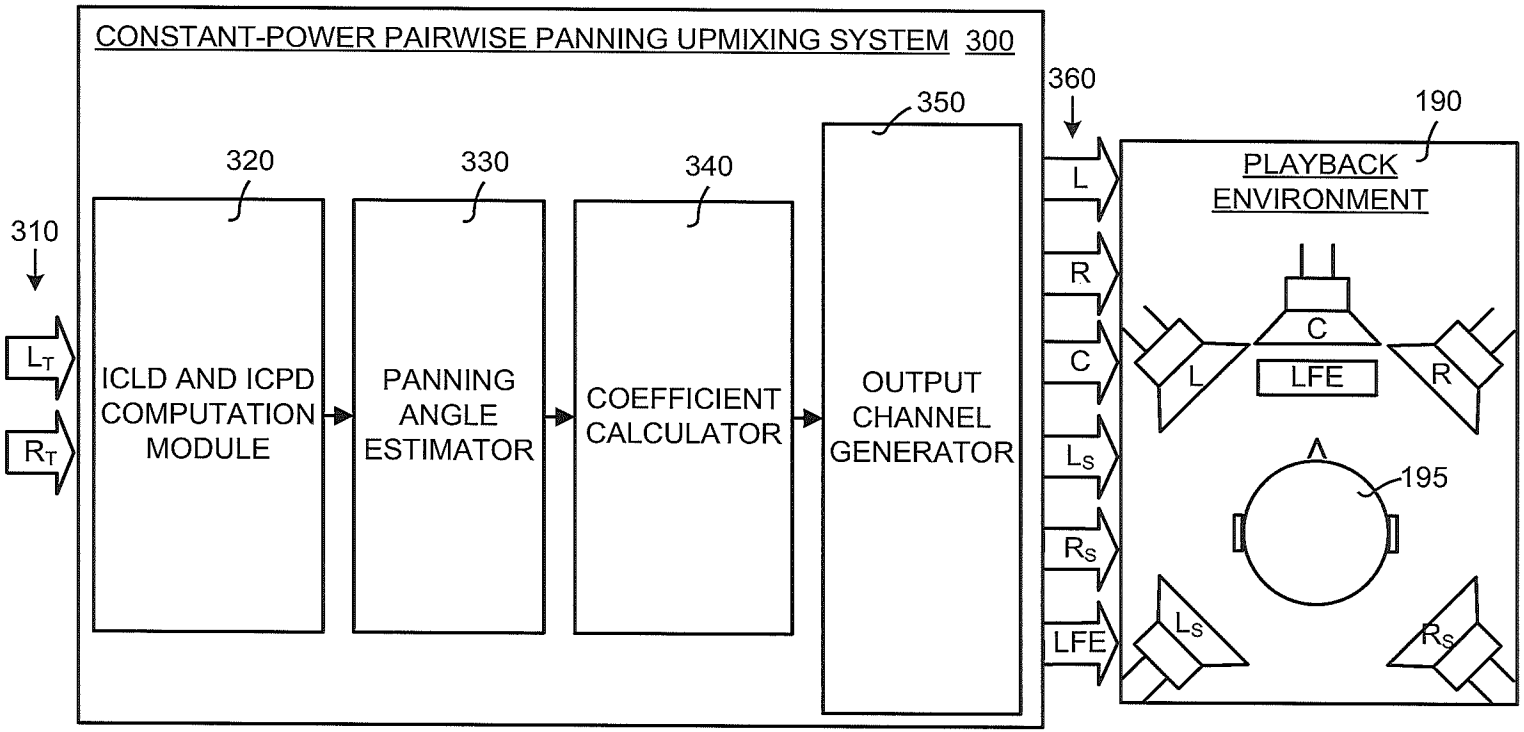
FIG. 3 is a block diagram illustrating details of an exemplary embodiment of the constant-power pairwise panning upmixing system and method shown in FIG. 1.

The system details of components of embodiments of the constant-power pairwise panning upmixing system will now be discussed. It should be noted that only a few of the several ways in which the system may be implemented are detailed below. Many variations are possible from that which is shown in FIG. 3. FIG. 3 is a block diagram illustrating details of an exemplary embodiment of the constant-power pairwise panning upmixing system 300 and method shown in FIG. 1. Embodiments of the system 300 and method operate in a computing environment (not shown), which is described in detail below. In particular, the system 300 and method are implemented on one or more computing devices including one or more processing devices.

Input to the system 300 includes a two-channel input audio signal 310 having a Left Total channel ($L_T$) and a Right Total channel ($R_T$). These two channel are input to an inter-channel level difference (ICLD) and inter-channel phase difference (ICPD) computation module 320. The computation module 320 computes the inter-channel level difference for each channel using the two input channels. Moreover, the computation module 320 calculates the inter-channel phase difference between the Left Total channel and the Right Total channel using the two input channels. This information is passed to a panning angle estimator 330.

Figure 4:
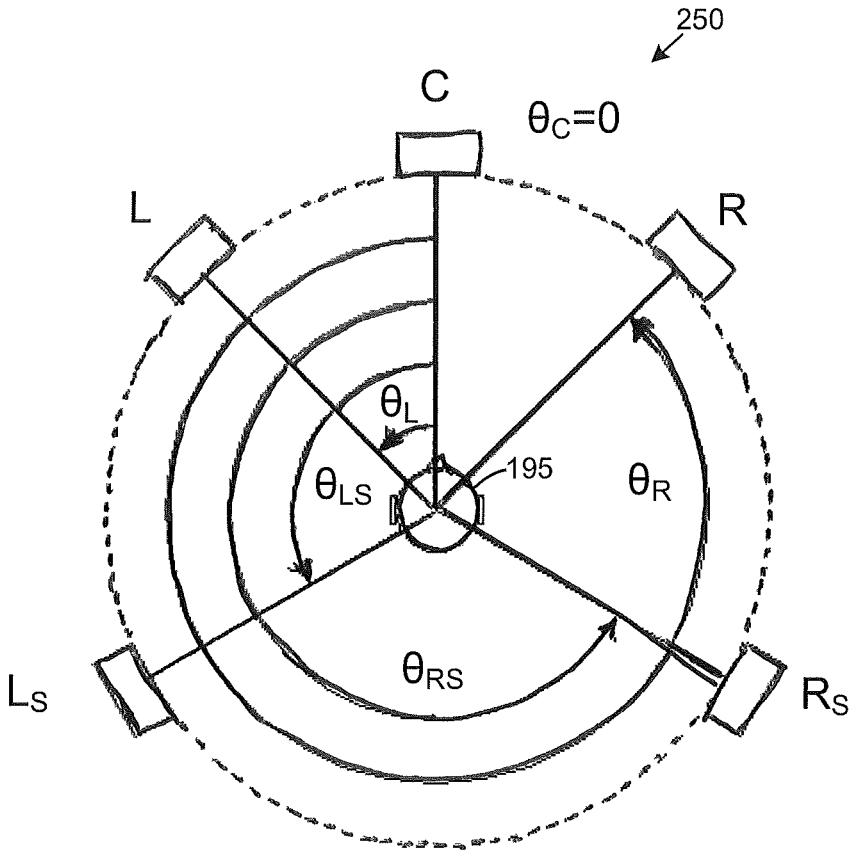
FIG. 4 is an illustration of the concept of panning angle.

Based on the inter-channel level difference, the estimator 330 estimates a panning angle for each output channel. The panning angle is the angle in the horizontal plane 250 from which the sound appears to originate during playback. FIG. 4 is an illustration of the concept of panning angle. In FIG. 4, a plan view of a 5.1 speaker configuration is shown situated in the horizontal plane 250. In FIG. 4 the panning angles of the speakers are illustrated. However, it is possible that a panning angle may be any angle from 0 degrees to 359 degrees in the horizontal plane 250. In other words, a panning angle may be located between physical speakers such that the sound appears to originate from a virtual sound source.

In FIG. 4, the Center speaker (C), which outputs information from the Center channel, is designated as the origin and has a panning angle of 0 degrees ($a_{ct}$=0). Moving counter-clockwise from the Center speaker, the Left speaker (L), which outputs information from the Left channel, has certain panning angle denoted as $a_{ll}$, and the Left Surround speaker (SL), which outputs information from the Left Surround channel, has a certain panning angle denoted as $l_{ess}$ (which is greater than $a_{ll}$). In addition, the Right Surround speaker, which outputs information from the Right Surround channel, has a certain panning angle denoted as $y_{rs}$. (which is greater than $l_{ess}$), and the Right speaker, which outputs information from the Right channel, has a certain panning angle denoted as $y_{r}$. (which is greater than $y_{rs}$.).

The panning angle estimations from the panning angle estimator 330 are passed to a coefficient calculator 340. The coefficient calculator 340 uses the estimated panning angle to calculate in-phase coefficients and out-of-phase coefficients (collectively called phase coefficients) for each output channel. Using these coefficients and the inter-channel phase difference, the coefficient calculator 340 determines the dematrixing coefficients for each output channel. These dematrixing coefficients and phase coefficients are passed to an output channel generator 350.

For each output channel, the output channel generator 350 multiplies the Left Total channel and the Right Total channel by their corresponding dematrixing coefficients to generate the particular output channel. Thus, at any given time during playback of audio content each output channel is a mixture of the Left Total channel and the Right Total channel. This mixture is determined by the dematrixing coefficients and especially the phase coefficients.

Once all of the discrete output channels have been generated, the output channel generator 350 outputs an upmixed multi-channel output audio signal 360. In the exemplary example shown in FIG. 3, the output audio signal is a 5.1 mix including all six channels of a 5.1 surround sound configuration. In other embodiments of the system 300 and method, any numbers of channels may be generated as long as the number of channels is greater than two. In addition, as noted above, each speaker in the target speaker layout 200 should lie approximately in the same horizontal plane as the listener's ears 260. The upmixed multi-channel output audio signal 360 is output for playback through speakers in the playback environment 190.

III. Operational Overview

Figure 5:
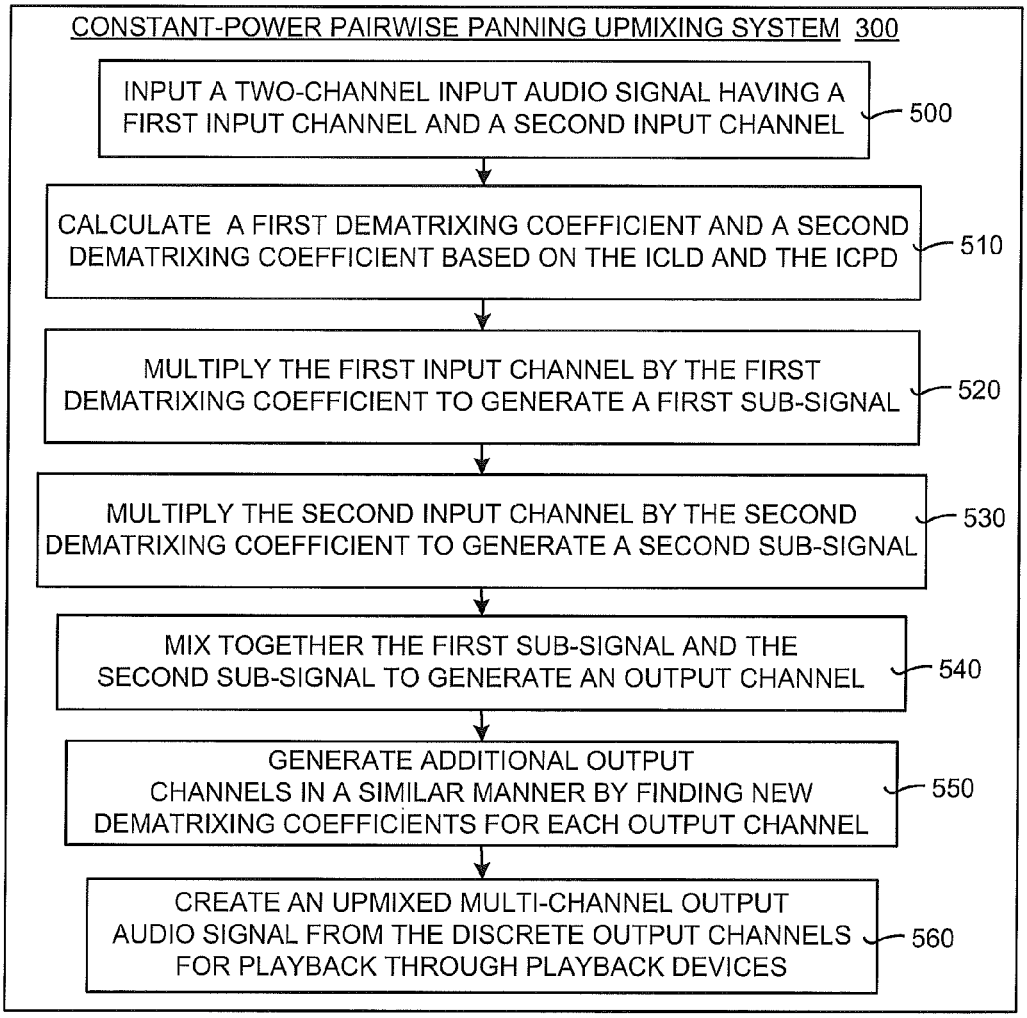
FIG. 5 is a flow diagram illustrating the general operation of embodiments of the constant-power pairwise panning upmixing system and method shown in FIGS. 1 and 3.

FIG. 5 is a flow diagram illustrating the general operation of embodiments of the constant-power pairwise panning upmixing system 300 and method shown in FIGS. 1 and 3. The operation begins by inputting a two-channel input audio signal having a first input channel and a second input channel (box 500). Next, the method calculates a first dematrixing coefficient and a second dematrixing coefficient based on an inter-channel level difference (ICLD) and an inter-channel phase difference (ICPD) (box 510). The method then multiplies the first input channel by the first dematrixing coefficient to generate a first sub-signal (box 520). In addition, the method multiplies the second input channel by the second dematrixing coefficient to generate a second sub-signal (box 530).

The method then mixes the first sub-signal and the second sub-signal together in a linear manner to generate an output channel (box 540). This process is repeated in a similar manner for each of the output channels by finding new dematrixing coefficients for each output channel (box 550). Although the dematrixing coefficients typically will be different for each output channel, this will not always be true. Each of the discrete output channels creates an upmixed multi-channel output audio signal for playback through playback devices (box 560), such as speakers or headphones.

IV. Operational Details

Figure 6:
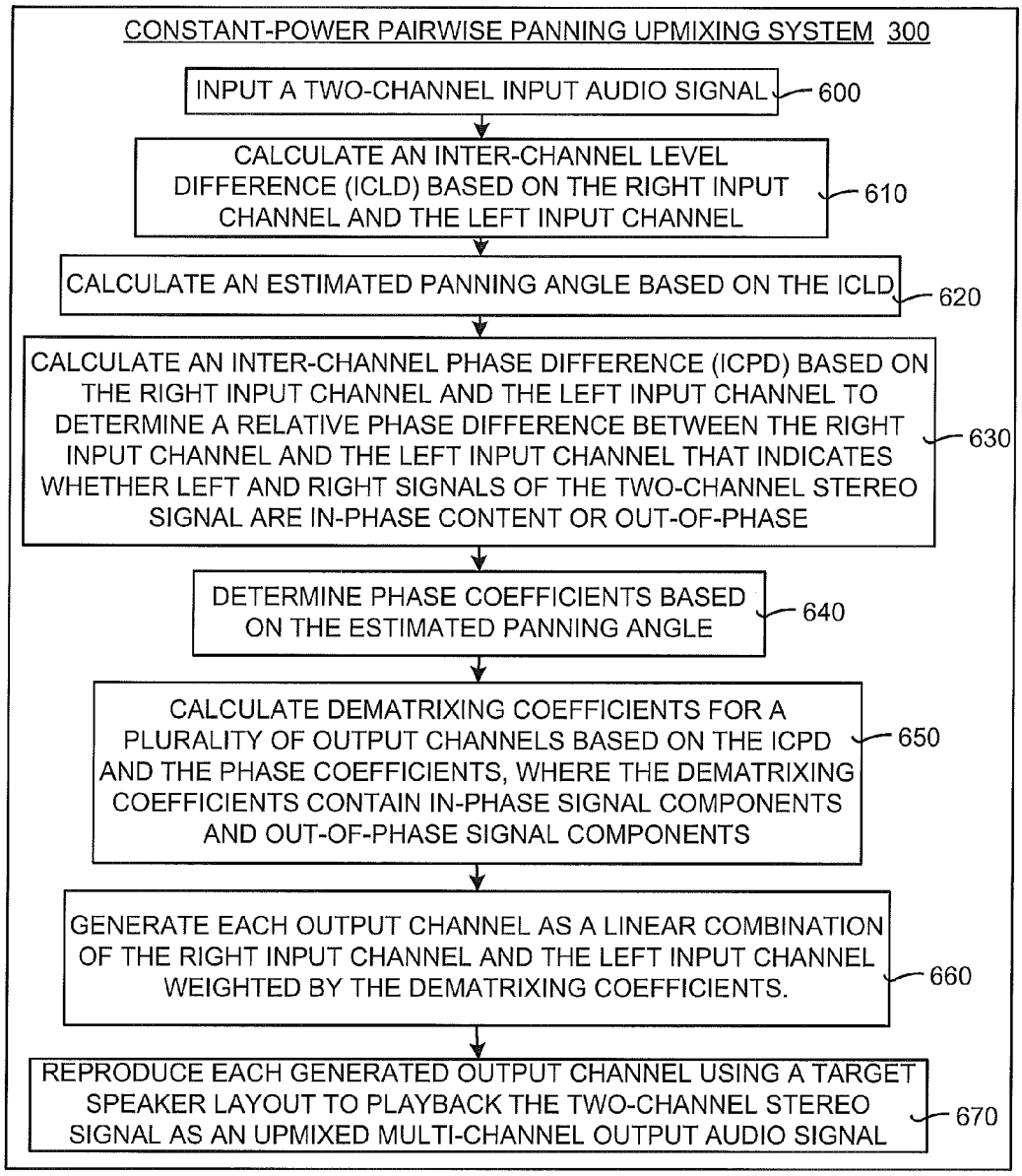
FIG. 6 is a flow diagram illustrating the details of an exemplary embodiment of the constant-power pairwise panning upmixing system and method shown in FIGS. 1, 3, and 5.

The operational details of embodiments of the constant-power pairwise panning upmixing system 300 and method now will be discussed. FIG. 6 is a flow diagram illustrating the details of an exemplary embodiment of the constant-power pairwise panning upmixing system 300 and method shown in FIGS. 1, 3, and 5. As shown in FIG. 6, the operation begins by inputting a two-channel input audio signal having a left input channel and a right input channel (box 600). Thus, the input signal is a stereo signal having a left and a right channel.

The method then calculates an inter-channel level difference between the left and right channels using the left and right channels (box 610). This calculation is shown in detail below. Moreover, the method uses the inter-channel level difference to compute an estimated panning angle (box 620). In addition, an inter-channel phase difference is computed by the method using the left and right input channels (box 630). This inter-channel phase difference determines a relative phase difference between the left and right input channels that indicates whether the left and right signals of the two-channel input audio signal are in-phase or out-of-phase.

Some embodiments of the constant-power pairwise panning upmixing system 300 and method utilize a panning angle (θ) to determine the downmix process and subsequent upmix process from the two-channel downmix. Moreover, some embodiments assume a Sin/Cos panning law. In these situations, the two-channel downmix is calculated as a function of the panning angle as:

$$L = \pm\cos\left(\theta\frac{\pi}{2}\right)X_i$$

$$R = \pm\sin\left(\theta\frac{\pi}{2}\right)X_i$$

where $X_i$ is an input channel, L and R are the downmix channels, θ is a panning angle (normalized between 0 and 1), and the polarity of the panning weights is determined by the location of input channel $X_i$. In traditional matrixing systems it is common for input channels located in front of the listener to be downmixed with in-phase signal components (in other words, with equal polarity of the panning weights) and for output channels located behind the listener to be downmixed with out-of-phase signal components (in other words, with opposite polarity of the panning weights).

Figure 7:
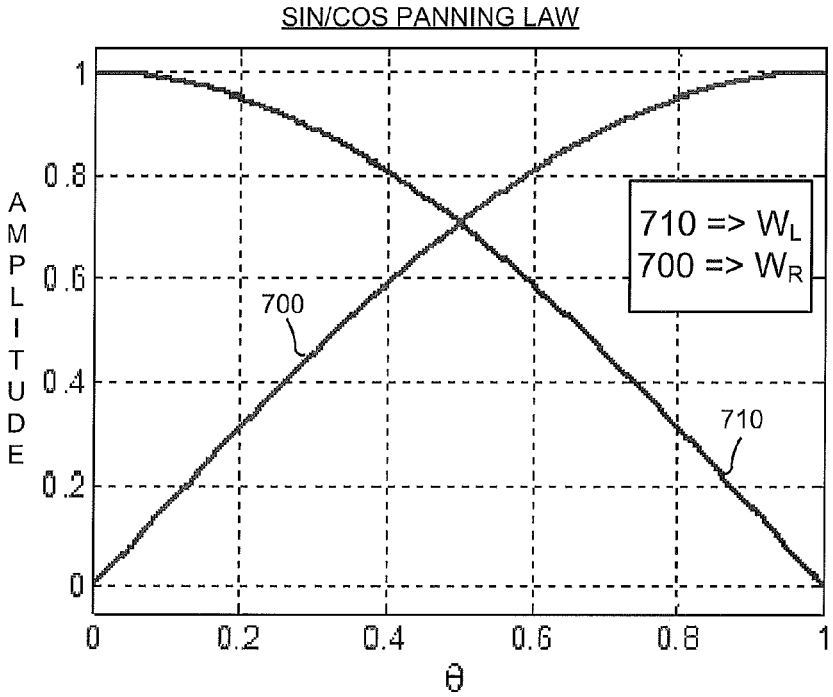
FIG. 7 illustrates the panning weights as a function of the panning angle (θ) for the Sin/Cos panning law.

FIG. 7 illustrates the panning weights as a function of the panning angle (θ) for the Sin/Cos panning law. The first plot 700 represents the panning weights for the right channel ($W_R$). The second plot 710 represents the weights for the left channel ($W_L$). By way of example and referring to FIG. 7, a center channel may use a panning angle of 0.5 leading to the downmix functions:

$$L=0.707\cdot C$$

$$R=0.707\cdot C$$

To synthesize the additional audio channels from a two-channel downmix, an estimate of the panning angle (or estimated panning angle, denoted as $\hat{\theta}$) can be calculated from the inter-channel level difference (denoted as ICLD). Let the ICLD be defined as:

$$ICLD = \frac{L^2}{L^2 + R^2}$$

Assuming that a signal component is generated via intensity panning using the Sin/Cos panning law, the ICLD can be expressed as a function of the panning angle estimate:

$$ICLD = \frac{\cos^2\left(\hat{\theta}\frac{\pi}{2}\right)}{\cos^2\left(\hat{\theta}\frac{\pi}{2}\right) + \sin^2\left(\hat{\theta}\frac{\pi}{2}\right)} = \cos^2\left(\hat{\theta}\frac{\pi}{2}\right)$$

The panning angle estimate then can be expressed as a function of the ICLD:

$$\hat{\theta} = \frac{2\cdot\cos^{-1}\left(\sqrt{ICLD}\right)}{\pi}$$

The following angle sum and difference identities will be used throughout the remaining derivations:

$$\sin(\alpha\pm\beta)=\sin(\alpha)\cos(\beta)\pm\cos(\alpha)\sin(\beta)$$

$$\cos(\alpha\pm\beta)=\cos(\alpha)\cos(\beta)\mp\sin(\alpha)\sin(\beta)$$

Moreover, the following derivations assume a 5.1 surround sound output configuration. However, this analysis can easily be applied to additional channels.

IV.A. Center Channel Synthesis

A Center channel is generated from a two-channel downmix using the following equation:

$$C=aL+bR$$

where the a and b coefficients are determined based on the panning angle estimate $\hat{\theta}$ to achieve certain pre-defined goals.

1. In-Phase Components

Figure 8:
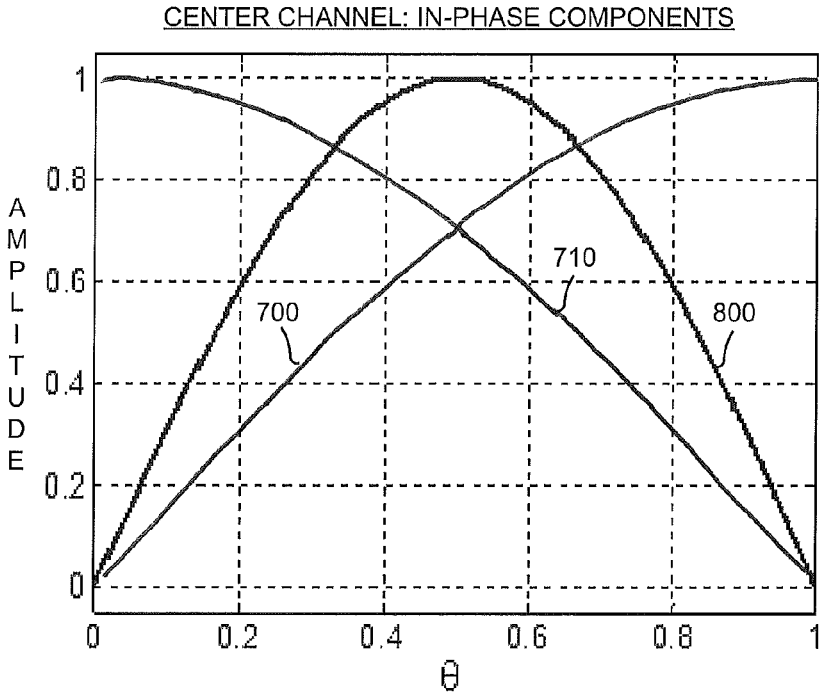
FIG. 8 illustrates panning behavior corresponding to an in-phase plot for a Center output channel.

For the in-phase components of the Center channel a desired panning behavior is illustrated in FIG. 8. FIG. 8 illustrates panning behavior corresponding to an in-phase plot 800 given by the equation:

$$C=\sin(\hat{\theta}\pi)$$

Substituting the desired Center channel panning behavior for in-phase components and the assumed Sin/Cos downmix functions yields:

$$\sin(\hat{\theta}\pi) = a\cdot\cos\left(\hat{\theta}\frac{\pi}{2}\right) + b\cdot\sin\left(\hat{\theta}\frac{\pi}{2}\right)$$

Using the angle sum identities, the dematrixing coefficients, including a first dematrixing coefficient (denoted as a) and a second dematrixing coefficients (denoted as b), can be derived as:

$$a = \sin\left(\hat{\theta}\frac{\pi}{2}\right)$$

$$b = \cos\left(\hat{\theta}\frac{\pi}{2}\right)$$

2. Out-of-Phase Components

Figure 9:
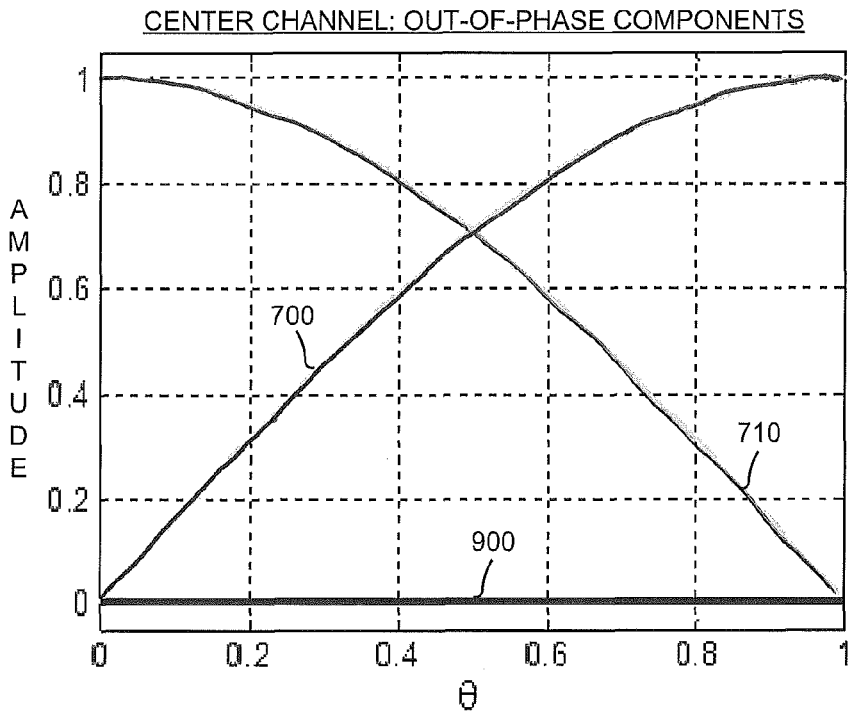
FIG. 9 illustrates panning behavior corresponding to an out-of-phase plot for the Center output channel.

For the out-of-phase components of the Center channel a desired panning behavior is illustrated in FIG. 9. FIG. 9 illustrates panning behavior corresponding to an out-of-phase plot 900 given by the equation:

$$C=0$$

Substituting the desired Center channel panning behavior for out-of-phase components and the assumed Sin/Cos downmix functions leads to:

$$0 = \sin(0) = a \cdot \cos(\hat{\theta}\frac{\pi}{2}) + b \cdot -\sin(\hat{\theta}\frac{\pi}{2})$$

Using the angle sum identities, the a and b coefficients can be derived as:

$$a = \sin(\hat{\theta}\frac{\pi}{2})$$

$$b = \cos(\hat{\theta}\frac{\pi}{2})$$

IV.B. Surround Channel Synthesis

The surround channels are generated from a two-channel downmix using the following equations:

$$Ls = aL - bR$$

$$Rs = aR - bL$$

where $L_S$ is the left surround channel and $R_S$ is the right surround channel. Moreover, the a and b coefficients are determined based on the estimated panning angle $\hat{\theta}$ to achieve certain pre-defined goals.

1. In-Phase Components

Figure 10:
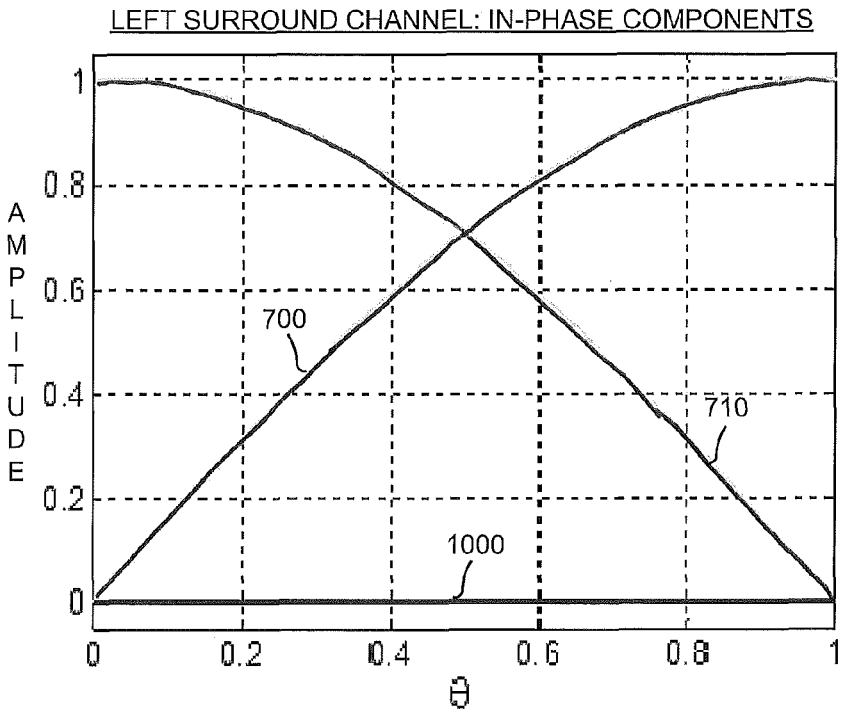
FIG. 10 illustrates panning behavior corresponding to an in-phase plot for a Left Surround output channel.

The ideal panning behavior for in-phase components of the Left Surround channel is illustrated in FIG. 10. FIG. 10 illustrates panning behavior corresponding to an in-phase plot 1000 given by the equation:

$$Ls = 0$$

Substituting the desired Left Surround channel panning behavior for in-phase components and the assumed Sin/Cos downmix functions leads to:

$$0 = \sin(0) = a \cdot \cos(\hat{\theta}\frac{\pi}{2}) - b \cdot \sin(\hat{\theta}\frac{\pi}{2})$$

Using the angle sum identities, the a and b coefficients are derived as:

$$a = \sin(\hat{\theta}\frac{\pi}{2})$$

$$b = \cos(\hat{\theta}\frac{\pi}{2})$$

2. Out-of-Phase Components

Figure 11:
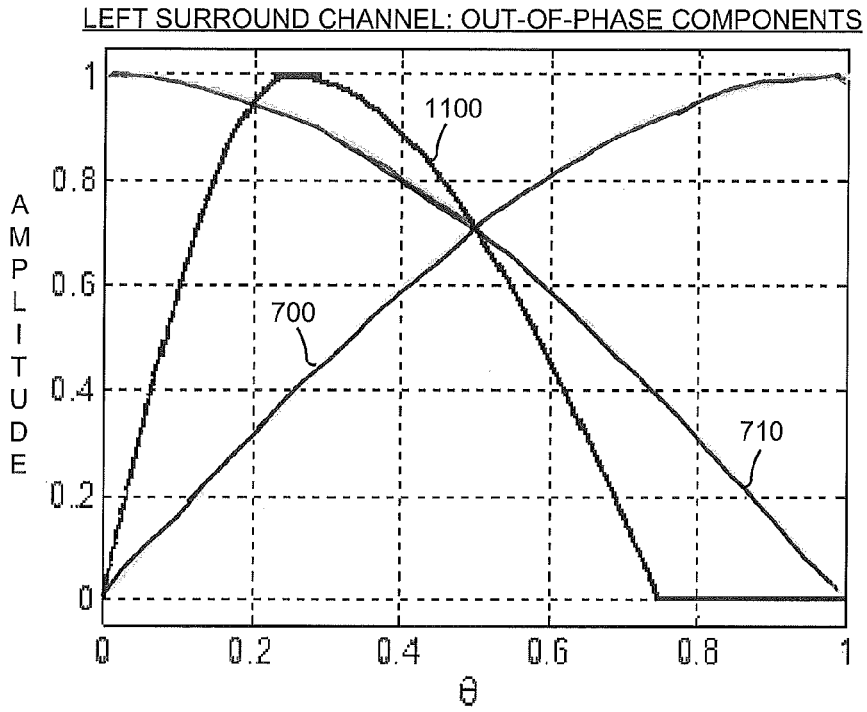
FIG. 11 illustrates two specific angles corresponding to downmix equations where the Left Surround and Right Surround channels are discretely encoded and decoded.

The goal for the Left Surround channel for out-of-phase components is to achieve panning behavior as illustrated by the out-of-phase plot 1100 in FIG. 11. FIG. 11 illustrates two specific angles corresponding to downmix equations where the Left Surround and Right Surround channels are discretely encoded and decoded (these angles are approximately 0.25 and 0.75 (corresponding to 45° and 135°) on the out-of-phase plot 1100 in FIG. 11). These angles are referred to as:

$\theta_{Ls}$=Left Surround encoding angle(~0.25)

$\theta_{Rs}$=Right Surround encoding angle(~0.75)

The a and b coefficients for the Left Surround channel are generated via a piecewise function due to the piecewise behavior of the desired output. For $\hat{\theta} \leq \theta_{Ls}$, the desired panning behavior for the Left Surround channel corresponds to:

$$Ls = \sin\left(\frac{\hat{\theta}}{\theta_{Ls}}\frac{\pi}{2}\right)$$

Substituting the desired Left Surround channel panning behavior for out-of-phase components and the assumed Sin/Cos downmix functions leads to:

$$\sin\left(\frac{\hat{\theta}}{\theta_{Ls}}\frac{\pi}{2}\right) = a \cdot \cos(\hat{\theta}\frac{\pi}{2}) - b \cdot -\sin(\hat{\theta}\frac{\pi}{2})$$

Using the angle sum identities, the a and b coefficients can be derived as:

$$a = \sin\left(\frac{\hat{\theta}}{\theta_{Ls}}\frac{\pi}{2} - \hat{\theta}\frac{\pi}{2}\right)$$

$$b = \cos\left(\frac{\hat{\theta}}{\theta_{Ls}}\frac{\pi}{2} - \hat{\theta}\frac{\pi}{2}\right)$$

For $\theta_{Ls} < \hat{\theta} \leq \theta_{Rs}$, the desired panning behavior for the Left Surround channel corresponds to:

$$Ls = \cos\left(\frac{\hat{\theta} - \theta_{Ls}}{\theta_{Rs} - \theta_{Ls}}\frac{\pi}{2}\right)$$

Substituting the desired Left Surround channel panning behavior for out-of-phase components and the assumed Sin/Cos downmix functions leads to:

$$\cos\left(\frac{\hat{\theta} - \theta_{Ls}}{\theta_{Rs} - \theta_{Ls}}\frac{\pi}{2}\right) = a \cdot \cos(\hat{\theta}\frac{\pi}{2}) - b \cdot -\sin(\hat{\theta}\frac{\pi}{2})$$

Using the angle sum identities, the a and b coefficients can be derived as:

$$a = \cos\left(\frac{\hat{\theta} - \theta_{Ls}}{\theta_{Rs} - \theta_{Ls}}\frac{\pi}{2} - \hat{\theta}\frac{\pi}{2}\right)$$

$$b = -\sin\left(\frac{\hat{\theta} - \theta_{Ls}}{\theta_{Rs} - \theta_{Ls}}\frac{\pi}{2} - \hat{\theta}\frac{\pi}{2}\right)$$

For $\hat{\theta} > \theta_{Rs}$, the desired panning behavior for the Left Surround channel corresponds to:

$$Ls = 0$$

Substituting the desired Left Surround channel panning behavior for out-of-phase components and the assumed Sin/Cos downmix functions leads to:

$$0 = \sin(0) = a \cdot \cos(\hat{\theta}\frac{\pi}{2}) - b \cdot -\sin(\hat{\theta}\frac{\pi}{2})$$

Using the angle sum identities, the a and b coefficients can be derived as:

$$a = \sin(\hat{\theta}\frac{\pi}{2})$$

$$b = -\cos(\hat{\theta}\frac{\pi}{2})$$

The a and b coefficients for the Right Surround channel generation are calculated similarly to those for the Left Surround channel generation as described above.

IV.C. Modified Left and Modified Right Channel Synthesis

The Left and Right channels are modified using the following equations to remove (either fully or partially) those components generated in the Center and Surround channels:

$$L'=aL-bR$$

$$R'=aR-bL$$

where the a and b coefficients are determined based on the panning angle estimate $\hat{\theta}$ to achieve certain pre-defined goals and L' is the modified Left channel and R' is the modified Right channel.

1. In-Phase Components

Figure 12:
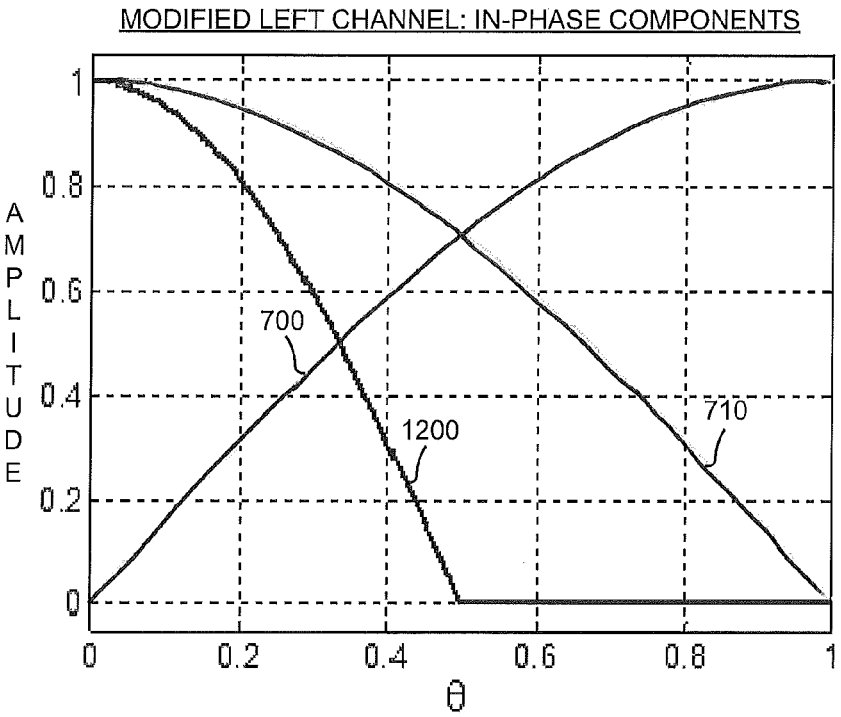
FIG. 12 illustrates panning behavior corresponding to an in-phase plot for a modified Left output channel.

The goal for the modified Left channel for in-phase components is to achieve panning behavior as illustrated by the in-phase plot 1200 in FIG. 12. In FIG. 12, a panning angle θ of 0.5 corresponds to a discrete Center channel. The a and b coefficients for the modified Left channel are generated via a piecewise function due to the piecewise behavior of the desired output.

For $\hat{\theta}\leq 0.5$, the desired panning behavior for the modified Left channel corresponds to:

$$L' = \cos\left(\frac{\hat{\theta}}{0.5}\frac{\pi}{2}\right)$$

Substituting the desired modified Left channel panning behavior for in-phase components and the assumed Sin/Cos downmix functions leads to:

$$\cos\left(\frac{\hat{\theta}}{0.5}\frac{\pi}{2}\right) = a\cdot\cos(\hat{\theta}\frac{\pi}{2}) - b\cdot\sin(\hat{\theta}\frac{\pi}{2})$$

Using the angle sum identities, the a and b coefficients can be derived as:

$$a = \cos\left(\frac{\hat{\theta}}{0.5}\frac{\pi}{2} - \hat{\theta}\frac{\pi}{2}\right)$$

$$b = \sin\left(\frac{\hat{\theta}}{0.5}\frac{\pi}{2} - \hat{\theta}\frac{\pi}{2}\right)$$

For $\hat{\theta}>0.5$, the desired panning behavior for the modified Left channel corresponds to:

$$L'=0$$

Substituting the desired modified Left channel panning behavior for in-phase components and the assumed Sin/Cos downmix functions leads to:

$$0 = \sin(0) = a\cdot\cos(\hat{\theta}\frac{\pi}{2}) - b\cdot\sin(\hat{\theta}\frac{\pi}{2}).$$

Using the angle sum identities, the a and b coefficients can be derived as:

$$a = \sin(\hat{\theta}\frac{\pi}{2})$$

$$b = \cos(\hat{\theta}\frac{\pi}{2}).$$

2. Out-of-Phase Components

Figure 13:
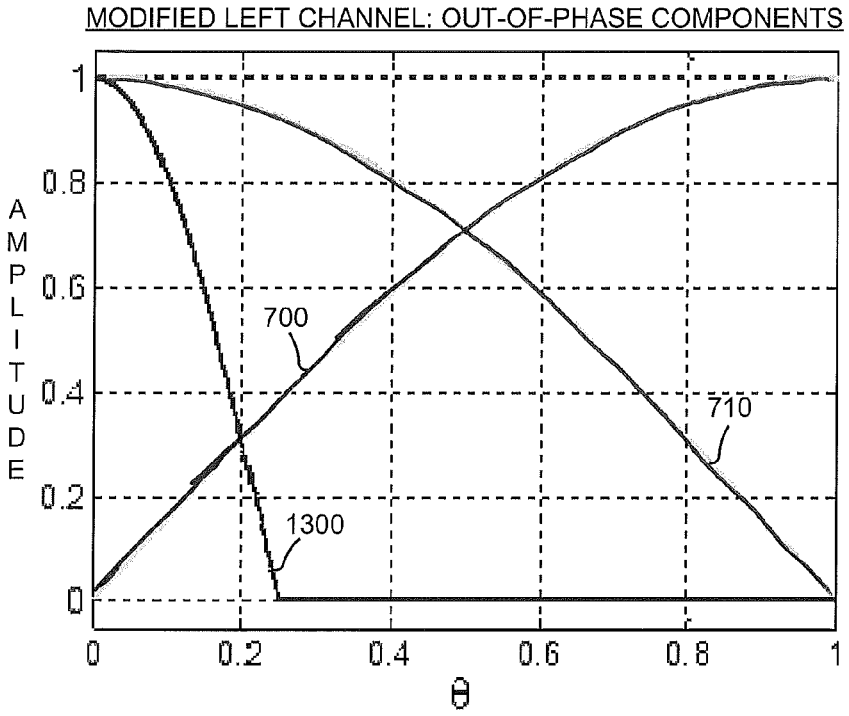
FIG. 13 illustrates panning behavior corresponding to an out-of-phase plot for the modified Left output channel.

The goal for the modified Left channel for out-of-phase components is to achieve panning behavior as illustrated by the out-of-phase plot 1300 in FIG. 13. In FIG. 13, a panning angle $\theta=\theta_{Ls}$ corresponds to the encoding angle for the Left Surround channel. The a and b coefficients for the modified Left channel are generated via a piecewise function due to the piecewise behavior of the desired output.

For $\hat{\theta}\leq\theta_{Ls}$, the desired panning behavior for the modified Left channel corresponds to:

$$L' = \cos\left(\frac{\hat{\theta}}{\theta_{Ls}}\frac{\pi}{2}\right).$$

Substituting the desired modified Left channel panning behavior for out-of-phase components and the assumed Sin/Cos downmix functions leads to:

$$\cos\left(\frac{\hat{\theta}}{\theta_{Ls}}\frac{\pi}{2}\right) = a\cdot\cos(\hat{\theta}\frac{\pi}{2}) - b\cdot -\sin(\hat{\theta}\frac{\pi}{2}).$$

Using the angle sum identities, the a and b coefficients can be derived as:

$$a = \cos\left(\frac{\hat{\theta}}{\theta_{Ls}}\frac{\pi}{2} - \hat{\theta}\frac{\pi}{2}\right)$$

$$b = -\sin\left(\frac{\hat{\theta}}{\theta_{Ls}}\frac{\pi}{2} - \hat{\theta}\frac{\pi}{2}\right).$$

For $\hat{\theta}>\theta_{Ls}$, the desired panning behavior for the modified Left channel corresponds to:

$$L'=0.$$

Substituting the desired modified Left channel panning behavior for out-of-phase components and the assumed Sin/Cos downmix functions leads to:

$$0 = \sin(0) = a\cdot\cos(\hat{\theta}\frac{\pi}{2}) - b\cdot -\sin(\hat{\theta}\frac{\pi}{2}).$$

Using the angle sum identities, the a and b coefficients can be derived as:

$$a = \sin(\hat{\theta}\frac{\pi}{2})$$

$$b = -\cos(\hat{\theta}\frac{\pi}{2}).$$

The a and b coefficients for the modified Right channel generation are calculated similarly to those for the modified Left channel generation as described above.

IV.D. Coefficient Interpolation

The channel synthesis derivations presented above are based on achieving desired panning behavior for source content that is either in-phase or out-of-phase. The relative phase difference of the source content can be determined through the Inter-Channel Phase Difference (ICPD) property defined as:

$$ICPD = \frac{\mathrm{Re}\{\Sigma\ L \cdot R^*\}}{\sqrt{\Sigma |L|^2}\sqrt{\Sigma |R|^2}},$$

where * denotes complex conjugation.

The ICPD value is bounded in the range [−1,1] where values of −1 indicate that the components are out-of-phase and values of 1 indicate that the components are in-phase. The ICPD property can then be used to determine the final a and b coefficients to use in the channel synthesis equations using linear interpolation. However, instead of interpolating the a and b coefficients directly, it can be noted that all of the a and b coefficients are generated using trigonometric functions of the panning angle estimate $\hat{\theta}$.

The linear interpolation is thus carried out on the angle arguments of the trigonometric functions. Performing the linear interpolation in this manner has two main advantages. First, it preserves the property that $a^2+b^2=1$ for any panning angle and ICPD value. Second, it reduces the number of trigonometric function calls required thereby reducing processing requirements.

The angle interpolation uses a modified ICPD value normalized to the range [0,1] calculated as:

$$ICPD' = \frac{ICPD + 1}{2}.$$

The channel outputs are computed as shown below.

1. Center Output Channel

The Center output channel is generated using the modified ICPD value, which is defined as:

$$C = aL + bR,$$

where $$a = \sin(ICPD' \cdot \alpha + (1 - ICPD') \cdot \beta)$$

$$b = \cos(ICPD' \cdot \alpha + (1 - ICPD') \cdot \beta).$$

The first term in the argument of the sine function above represents the in-phase component of the first dematrixing coefficient, while the second term represents the out-of-phase component. Thus, α represents an in-phase coefficient and β represents an out-of-phase coefficient. Together the in-phase coefficient and the out-of phase coefficient are known as the phase coefficients.

Referring again to FIG. 6, for each output channel the method calculates the phase coefficients based on the estimated panning angle (box 640). For the Center output channel, the in-phase coefficient and the out-of-phase coefficient are given as:

$$\alpha = \hat{\theta}\frac{\pi}{2}$$

$$\beta = \hat{\theta}\frac{\pi}{2}.$$

2. Left Surround Output Channel

The Left Surround output channel is generated using the modified ICPD value, which is defined as:

$$Ls = aL - bR$$

where $$a = \sin(ICPD' \cdot \alpha + (1 - ICPD') \cdot \beta)$$

$$b = \cos(ICPD' \cdot \alpha + (1 - ICPD') \cdot \beta)$$

and $$\alpha = \hat{\theta}\frac{\pi}{2}$$

$$\beta = \begin{cases} \frac{\hat{\theta}}{\theta_{Ls}}\frac{\pi}{2} - \hat{\theta}\frac{\pi}{2}, & \hat{\theta} \le \theta_{Ls} \\ \frac{\hat{\theta} - \theta_{Ls}}{\theta_{Rs} - \theta_{Ls}}\frac{\pi}{2} - \hat{\theta}\frac{\pi}{2} + \frac{\pi}{2}, & \theta_{Ls} < \hat{\theta} \le \theta_{Rs} \\ \pi - \hat{\theta}\frac{\pi}{2}, & \hat{\theta} > \theta_{Rs} \end{cases}.$$

3. Right Surround Output Channel

The Right Surround output channel is generated using the modified ICPD value, which is defined as:

$$Rs = aR - bL$$

where $$a = \sin(ICPD' \cdot \alpha + (1 - ICPD') \cdot \beta)$$

$$b = \cos(ICPD' \cdot \alpha + (1 - ICPD') \cdot \beta)$$

and $$\alpha = (1 - \hat{\theta})\frac{\pi}{2}$$

$$\beta = \begin{cases} \frac{(1 - \hat{\theta})}{\theta_{Ls}}\frac{\pi}{2} - (1 - \hat{\theta})\frac{\pi}{2}, & (1 - \hat{\theta}) \le \theta_{Ls} \\ \frac{(1 - \hat{\theta}) - \theta_{Ls}}{\theta_{Rs} - \theta_{Ls}}\frac{\pi}{2} - (1 - \hat{\theta})\frac{\pi}{2} + \frac{\pi}{2}, & \theta_{Ls} < (1 - \hat{\theta}) \le \theta_{Rs} \\ \pi - (1 - \hat{\theta})\frac{\pi}{2}, & (1 - \hat{\theta}) > \theta_{Rs} \end{cases}.$$

Note that the a and b coefficients for the Right Surround channel are generated similarly to the Left Surround channel, apart from using $(1-\hat{\theta})$ as the panning angle instead of $\hat{\theta}$.

4. Modified Left Output Channel

The modified Left output channel is generated using the modified ICPD value as follows:

$$L' = aL - bR$$

where $$a = \sin(ICPD' \cdot \alpha + (1 - ICPD') \cdot \beta)$$

$$b = \cos(ICPD' \cdot \alpha + (1 - ICPD') \cdot \beta)$$

and $$\alpha = \begin{cases} \frac{\pi}{2} - \frac{\hat{\theta}}{0.5}\frac{\pi}{2} + \hat{\theta}\frac{\pi}{2}, & \hat{\theta} \le 0.5 \\ \hat{\theta}\frac{\pi}{2}, & \hat{\theta} > 0.5 \end{cases}$$

$$\beta = \begin{cases} \frac{\hat{\theta}}{\theta_{Ls}}\frac{\pi}{2} - \hat{\theta}\frac{\pi}{2} + \frac{\pi}{2}, & \hat{\theta} \le \theta_{Ls} \\ \pi - \hat{\theta}\frac{\pi}{2}, & \hat{\theta} > \theta_{Ls} \end{cases}.$$

5. Modified Right Output Channel

The modified Right output channel is generated using the modified ICPD value as follows:

$$R' = aR - bL$$

where $$a = \sin(ICPD' \cdot \alpha + (1 - ICPD') \cdot \beta)$$

$$b = \cos(ICPD' \cdot \alpha + (1 - ICPD') \cdot \beta)$$

and $$\alpha = \begin{cases} \frac{\pi}{2} - \frac{(1-\hat{\theta})}{0.5}\frac{\pi}{2} + (1-\hat{\theta})\frac{\pi}{2}, & (1-\hat{\theta}) \le 0.5 \\ (1-\hat{\theta})\frac{\pi}{2}, & (1-\hat{\theta}) > 0.5 \end{cases}$$

$$\beta = \begin{cases} \frac{(1-\hat{\theta})}{\theta_{Ls}}\frac{\pi}{2} - (1-\hat{\theta})\frac{\pi}{2} + \frac{\pi}{2}, & (1-\hat{\theta}) \le \theta_{Ls} \\ \pi - (1-\hat{\theta})\frac{\pi}{2}, & (1-\hat{\theta}) > \theta_{Ls} \end{cases}.$$

Note that the a and b coefficients for the Right channel are generated similarly to the Left channel, apart from using $(1-\hat{\theta})$ as the panning angle instead of $\hat{\theta}$.

The subject matter discussed above is a system for generating Center, Left Surround, Right Surround, Left, and Right channels from a two-channel downmix. However, the system may be easily modified to generate other additional audio channels by defining additional panning behaviors.

Referring again to FIG. 6, it can be seen from the above discussion that for each output channel the method calculated the dematrixing coefficients based on the inter-channel phase difference and the phase coefficients (box 650). Moreover, the dematrixing coefficients contain both in-phase signal components and out-of-phase signal components. Further, each output channel is generated as different linear combinations of the right input channel and the left input channel weighted by their corresponding dematrixing coefficients (box 660).

After generating the output channels to obtain the upmixed multi-channel output audio signal, each output channel is output for reproduction in the playback environment 190 (box 670). The reproduction system may then play each audio channel over a target speaker layout. This playback will substantially recreate the original audio content before it was downmixed to two channels.

V. Alternate Embodiments and Exemplary Operating Environment

Many other variations than those described herein will be apparent from this document. For example, depending on the embodiment, certain acts, events, or functions of any of the methods and algorithms described herein can be performed in a different sequence, can be added, merged, or left out altogether (such that not all described acts or events are necessary for the practice of the methods and algorithms). Moreover, in certain embodiments, acts or events can be performed concurrently, such as through multi-threaded processing, interrupt processing, or multiple processors or processor cores or on other parallel architectures, rather than sequentially. In addition, different tasks or processes can be performed by different machines and computing systems that can function together.

The various illustrative logical blocks, modules, methods, and algorithm processes and sequences described in connection with the embodiments disclosed herein can be implemented as electronic hardware, computer software, or combinations of both. To clearly illustrate this interchangeability of hardware and software, various illustrative components, blocks, modules, and process actions have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of this document.

The various illustrative logical blocks and modules described in connection with the embodiments disclosed herein can be implemented or performed by a machine, such as a general purpose processor, a processing device, a computing device having one or more processing devices, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor and processing device can be a microprocessor, but in the alternative, the processor can be a controller, microcontroller, or state machine, combinations of the same, or the like. A processor can also be implemented as a combination of computing devices, such as a combination of a DSP and a microprocessor, a plurality of microprocessors, one or more microprocessors in conjunction with a DSP core, or any other such configuration.

Embodiments of the constant-power pairwise panning upmixing system 300 and method described herein are operational within numerous types of general purpose or special purpose computing system environments or configurations. In general, a computing environment can include any type of computer system, including, but not limited to, a computer system based on one or more microprocessors, a mainframe computer, a digital signal processor, a portable computing device, a personal organizer, a device controller, a computational engine within an appliance, a mobile phone, a desktop computer, a mobile computer, a tablet computer, a smartphone, and appliances with an embedded computer, to name a few.

Such computing devices can be typically be found in devices having at least some minimum computational capability, including, but not limited to, personal computers, server computers, hand-held computing devices, laptop or mobile computers, communications devices such as cell phones and PDA's, multiprocessor systems, microprocessor-based systems, set top boxes, programmable consumer electronics, network PCs, minicomputers, mainframe computers, audio or video media players, and so forth. In some embodiments the computing devices will include one or more processors. Each processor may be a specialized microprocessor, such as a digital signal processor (DSP), a very long instruction word (VLIW), or other microcontroller, or can be conventional central processing units (CPUs) having one or more processing cores, including specialized graphics processing unit (GPU)-based cores in a multi-core CPU.

The process actions of a method, process, or algorithm described in connection with the embodiments disclosed herein can be embodied directly in hardware, in a software module executed by a processor, or in any combination of the two. The software module can be contained in computer-readable media that can be accessed by a computing device. The computer-readable media includes both volatile and non-volatile media that is either removable, non-removable, or some combination thereof. The computer-readable media is used to store information such as computer-readable or computer-executable instructions, data structures, program modules, or other data. By way of example, and not limitation, computer readable media may comprise computer storage media and communication media.

Computer storage media includes, but is not limited to, computer or machine readable media or storage devices such as Bluray discs (BD), digital versatile discs (DVDs), compact discs (CDs), floppy disks, tape drives, hard drives, optical drives, solid state memory devices, RAM memory, ROM memory, EPROM memory, EEPROM memory, flash memory or other memory technology, magnetic cassettes, magnetic tapes, magnetic disk storage, or other magnetic storage devices, or any other device which can be used to store the desired information and which can be accessed by one or more computing devices.

A software module can reside in the RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an application specific integrated circuit (ASIC). The ASIC can reside in a user terminal. Alternatively, the processor and the storage medium can reside as discrete components in a user terminal.

The phrase "non-transitory" as used in this document means "enduring or long-lived". The phrase "non-transitory computer-readable media" includes any and all computer-readable media, with the sole exception of a transitory, propagating signal. This includes, by way of example and not limitation, non-transitory computer-readable media such as register memory, processor cache and random-access memory (RAM).

Retention of information such as computer-readable or computer-executable instructions, data structures, program modules, and so forth, can also be accomplished by using a variety of the communication media to encode one or more modulated data signals, electromagnetic waves (such as carrier waves), or other transport mechanisms or communications protocols, and includes any wired or wireless information delivery mechanism. In general, these communication media refer to a signal that has one or more of its characteristics set or changed in such a manner as to encode information or instructions in the signal. For example, communication media includes wired media such as a wired network or direct-wired connection carrying one or more modulated data signals, and wireless media such as acoustic, radio frequency (RF), infrared, laser, and other wireless media for transmitting, receiving, or both, one or more modulated data signals or electromagnetic waves. Combinations of the any of the above should also be included within the scope of communication media.

Further, one or any combination of software, programs, computer program products that embody some or all of the various embodiments of the post-encoding bitrate reduction system 100 and method described herein, or portions thereof, may be stored, received, transmitted, or read from any desired combination of computer or machine readable media or storage devices and communication media in the form of computer executable instructions or other data structures.

Embodiments of the constant-power pairwise panning upmixing system 300 and method described herein may be further described in the general context of computer-executable instructions, such as program modules, being executed by a computing device. Generally, program modules include routines, programs, objects, components, data structures, and so forth, which perform particular tasks or implement particular abstract data types. The embodiments described herein may also be practiced in distributed computing environments where tasks are performed by one or more remote processing devices, or within a cloud of one or more devices, that are linked through one or more communications networks. In a distributed computing environment, program modules may be located in both local and remote computer storage media including media storage devices. Still further, the aforementioned instructions may be implemented, in part or in whole, as hardware logic circuits, which may or may not include a processor.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

Moreover, although the subject matter has been described in language specific to structural features and methodological acts, it is to be understood that the subject matter defined in the appended claims is not necessarily limited to the specific features or acts described above. Rather, the specific features and acts described above are disclosed as example forms of implementing the claims.

What is claimed is:

1. A method performed by one or more processing devices for upmixing a two-channel input audio signal having a first input channel and a second input channel into an upmixed multi-channel output audio signal having greater than two channels, comprising:

calculating a first dematrixing coefficient, denoted as a, and a second dematrixing coefficient, denoted as b, based on an inter-channel level difference, denoted as ICLD, and an inter-channel phase difference between the first and second input channels, denoted as ICPD, wherein the first dematrixing coefficient is a combination of an in-phase signal component and an out-of-phase signal component;

calculating an estimated panning angle from the inter-channel level difference;

calculating an in-phase coefficient and an out-of-phase coefficient based on the estimated panning angle, wherein the in-phase signal component is based on the inter-channel phase difference multiplied by the in-phase coefficient and the out-of-phase signal component is based on the inter-channel phase difference multiplied by the out-of-phase coefficient;

multiplying the first input channel by the first dematrixing coefficient to generate a first sub-signal and the second input channel by the second dematrixing coefficient to generate a second sub-signal;

mixing the first sub-signal and the second sub-signal in a linear manner to generate an output channel of the upmixed multi-channel output audio signal; and outputting the generated output channel for playback through speakers.

2. The method of claim 1, wherein calculating the first and second dematrixing coefficients further comprises calculating the inter-channel level difference for the two-channel input audio signal as a ratio of a left channel and a sum of the left channel and a right channel.

3. The method of claim 2, wherein calculating the inter-channel level difference further comprises using the equation:

$$ICLD = \frac{L^2}{L^2 + R^2}$$

where L is the left channel and R is the right channel.

4. The method of claim 1, wherein calculating the first and second dematrixing coefficients further comprises calculating the estimated panning angle, denoted as $\hat{\theta}$, based on the inter-channel level difference, wherein the estimated panning angle is an estimate of an original panning angle associated with the two-channel input audio signal.

5. The method of claim 4, wherein calculating the estimated panning angle further comprises using the equation:

$$\hat{\theta} = \frac{2 \cdot \cos^{-1}\left(\sqrt{ICLD}\right)}{\pi}.$$

6. The method of claim 4, wherein calculating the first and second dematrixing coefficients further comprises calculating the first and second dematrixing coefficients based on the inter-channel phase difference, the in-phase coefficient, and the out-of-phase coefficient.

7. The method of claim 1, wherein calculating the first and second dematrixing coefficients further comprises:

determining the inter-channel phase difference between the first and the second input channels, based on the equation:

$$ICPD = \frac{\mathrm{Re}\{\Sigma\ L \cdot R^*\}}{\sqrt{\Sigma\,|L|^2}\,\sqrt{\Sigma\,|R|^2}}$$

where * denotes complex conjugation, L is the first input channel, and R is the second input channel and wherein the inter-channel phase difference indicates whether the first input channel is in phase or out of phase with the second input channel at a given time.

8. The method of claim 1, wherein calculating the first and second dematrixing coefficients further comprises:

calculating the first dematrixing coefficient using the equation:

$$a = \sin(ICPD' \cdot \alpha + (1 - ICPD') \cdot \beta), \text{ and}$$

calculating the second dematrixing coefficient using the equation:

$$b = \cos(ICPD' \cdot \alpha + (1 - ICPD') \cdot \beta),$$

where $\alpha$ is an in-phase coefficient and $\beta$ is an out-of-phase coefficient and are both based on the estimated panning angle, denoted as $\hat{\theta}$, and ICPD' is a modified inter-channel phase difference given by:

$$ICPD' = \frac{ICPD + 1}{2}$$

and the inter-channel phase difference is given by:

$$ICPD \doteq \frac{\mathrm{Re}\{\Sigma\ L \cdot R^*\}}{\sqrt{\Sigma\,|L|^2}\,\sqrt{\Sigma\,|R|^2}}$$

where * denotes complex conjugation, L is a left channel and R is a right channel.

9. A method for generating an upmixed multi-channel output audio signal having N output channels from a two-channel input audio signal having a left input channel and a right input channel, where N is a positive integer greater than two, comprising:

calculating a first dematrixing coefficient, denoted as a, based on a first trigonometric function of a combination of an in-phase signal component and an out-of-phase signal component;

calculating a second dematrixing coefficient, denoted as b, based on a second trigonometric function of the combination of the in-phase signal component and the out-of-phase signal component;

generating each of the N output channels by mixing in a linear manner the first dematrixing coefficient times the left or right input channel and the second dematrixing coefficient times the right or left input channel;

calculating an inter-channel level difference, denoted as ICLD, based on the left input channel and the right input channel;

calculating an estimated panning angle from the inter-channel level difference;

calculating an in-phase coefficient, denoted as α, and an out-of-phase coefficient, denoted as β, based on the estimated panning angle;

calculating an inter-channel phase difference, denoted as ICPD, based on the left input channel and the right input channel to determine a relative phase difference between the left input channel and right input channel that indicates whether the left input channel is in phase or out of phase with the right input channel and vice versa; and causing each of the N output channels of the upmixed multi-channel output audio signal to be played back through speakers in a multi-channel playback environment;

wherein the in-phase signal component is based on the inter-channel phase difference multiplied by the in-phase coefficient and the out-of-phase signal component is based on the inter-channel phase difference multiplied by the out-of-phase coefficient.

10. The method of claim 9, wherein the first trigonometric function is a sine function and the second trigonometric function is a cosine function.

11. The method of claim 9, wherein the combination of the in-phase signal component and the out-of-phase signal component is a linear combination.

12. The method of claim 9, wherein calculating the inter-channel level difference further comprises the equation:

$$ICLD = \frac{L^2}{L^2 + R^2}$$

where L is the left input channel and R is the right input channel.

13. The method of claim 12, wherein calculating the inter-channel phase difference further comprises the equation:

$$ICPD = \frac{\mathrm{Re}\{\Sigma\ L \cdot R^*\}}{\sqrt{\Sigma\,|L|^2}\,\sqrt{\Sigma\,|R|^2}}$$

where * denotes complex conjugation.

14. The method of claim 13, further comprising calculating a modified inter-channel phase difference, denoted as ICPD', given as:

$$ICPD' = \frac{ICPD + 1}{2}.$$

15. The method of claim 14, wherein calculating the first dematrixing coefficient further comprises the equation:

$$a = \sin(ICPD' \cdot \alpha + (1 - ICPD') \cdot \beta).$$

16. The method of claim 15, wherein calculating the second dematrixing coefficient further comprises the equation:

$$b = \cos(ICPD' \cdot \alpha + (1 - ICPD') \cdot \beta).$$

17. The method of claim 16, wherein calculating the estimated panning angle, denoted as $\hat{\theta}$, further comprises the equation:

$$\hat{\theta} = \frac{2 \cdot \cos^{-1}\left(\sqrt{ICLD}\right)}{\pi}.$$

18. The method of claim 17, further comprising generating a Center channel of the N output channels by:

calculating an in-phase coefficient for the Center channel as:

$$\alpha = \hat{\theta}\frac{\pi}{2},$$

and calculating an out-of-phase coefficient for the Center channel as:

$$\beta = \hat{\theta}\frac{\pi}{2}.$$

19. The method of claim 17, further comprising generating a Left Surround channel of the N output channels by:

calculating an in-phase coefficient for the Left Surround channel as:

$$\alpha = \hat{\theta}\frac{\pi}{2},$$

and calculating an out-of-phase coefficient for the Left Surround channel as:

$$\beta = \begin{cases} \dfrac{\hat{\theta}}{\theta_{Ls}}\dfrac{\pi}{2} - \hat{\theta}\dfrac{\pi}{2}, & \hat{\theta} \le \theta_{Ls} \\ \dfrac{\hat{\theta} - \theta_{Ls}}{\theta_{Rs} - \theta_{Ls}}\dfrac{\pi}{2} - \hat{\theta}\dfrac{\pi}{2} + \dfrac{\pi}{2}, & \theta_{Ls} < \hat{\theta} \le \theta_{Rs} \\ \pi - \hat{\theta}\dfrac{\pi}{2}, & \hat{\theta} > \theta_{Rs} \end{cases},$$

where $\theta_{Rs}$, is a Right Surround encoding angle and $\theta_{Ls}$, is a Left Surround encoding angle.

20. The method of claim 17, further comprising generating a Right Surround channel of the N output channels by:

calculating an in-phase coefficient for the Right Surround channel as:

$$\alpha = (1 - \hat{\theta})\frac{\pi}{2},$$

and calculating an out-of-phase coefficient for the Right Surround channel as:

$$\beta = \begin{cases} \frac{(1-\hat{\theta})}{\theta_{Ls}}\frac{\pi}{2} - (1-\hat{\theta})\frac{\pi}{2}, & (1-\hat{\theta}) \le \theta_{Ls} \\ \frac{(1-\hat{\theta}) - \theta_{Ls}}{\theta_{Rs} - \theta_{Ls}}\frac{\pi}{2} - (1-\hat{\theta})\frac{\pi}{2} + \frac{\pi}{2}, & \theta_{Ls} < (1-\hat{\theta}) \le \theta_{Rs} \\ \pi - (1-\hat{\theta})\frac{\pi}{2}, & (1-\hat{\theta}) > \theta_{Rs} \end{cases},$$

where $\theta_{Rs}$ is a Right Surround encoding angle and $\theta_{Ls}$, is a Left Surround encoding angle.

21. The method of claim 17, further comprising generating a modified Left channel of the N output channels by:

calculating an in-phase coefficient for the modified Left channel as:

$$\alpha = \begin{cases} \frac{\pi}{2} - \frac{\hat{\theta}}{0.5}\frac{\pi}{2} + \hat{\theta}\frac{\pi}{2}, & \hat{\theta} \le 0.5 \\ \hat{\theta}\frac{\pi}{2}, & \hat{\theta} > 0.5 \end{cases},$$

and calculating an out-of-phase coefficient for the modified Left channel as:

$$\beta = \begin{cases} \frac{\hat{\theta}}{\theta_{Ls}}\frac{\pi}{2} - \hat{\theta}\frac{\pi}{2} + \frac{\pi}{2}, & \hat{\theta} \le \theta_{Ls} \\ \pi - \hat{\theta}\frac{\pi}{2}, & \hat{\theta} > \theta_{Ls} \end{cases},$$

where $\theta_{Rs}$, is a Right Surround encoding angle and $\theta_{Ls}$, is a Left Surround encoding angle.

22. The method of claim 17, further comprising generating a modified Right channel of the N output channels by:

calculating an in-phase coefficient for the modified Right channel as:

$$\alpha = \begin{cases} \frac{\pi}{2} - \frac{(1-\hat{\theta})}{0.5}\frac{\pi}{2} + (1-\hat{\theta})\frac{\pi}{2}, & (1-\hat{\theta}) \le 0.5 \\ (1-\hat{\theta})\frac{\pi}{2}, & (1-\hat{\theta}) > 0.5 \end{cases},$$

and calculating an out-of-phase coefficient for the modified Right channel as:

$$\beta = \begin{cases} \frac{(1-\hat{\theta})}{\theta_{Ls}}\frac{\pi}{2} - (1-\hat{\theta})\frac{\pi}{2} + \frac{\pi}{2}, & (1-\hat{\theta}) \le \theta_{Ls} \\ \pi - (1-\hat{\theta})\frac{\pi}{2}, & (1-\hat{\theta}) > \theta_{Ls} \end{cases},$$

where $\theta_{Rs}$, is a Right Surround encoding angle and $\theta_{Ls}$, is a Left Surround encoding angle.

23. A method performed by one or more processing devices for upmixing a two-channel input audio signal, comprising:

calculating an estimated panning angle from an inter-channel level difference between first and second channels of the two-channel input audio signal;

calculating an in-phase coefficient and an out-of-phase coefficient based on the estimated panning angle;

calculating a first dematrixing coefficient based on the inter-channel level difference and an inter-channel phase difference between the first and second channels;

calculating an in-phase signal component based on the inter-channel phase difference multiplied by the in-phase coefficient and the out-of-phase signal component based on the inter-channel phase difference multiplied by the out-of-phase coefficient; and generating a channel of an upmixed multi-channel output audio signal by mixing the first dematrixing coefficient time the first or second channels of the two-channel input audio signal and causing the channel of an upmixed multi-channel output audio signal to be played back in a multi-channel playback environment.

* * * * *